US005082140A

United States Patent [19]

Swenson

[11] Patent Number: 5,082,140

[45] Date of Patent: Jan. 21, 1992

[54] BOWL FOR SERVING POPCORN AND THE LIKE

[76] Inventor: Julius A. Swenson, 4209 Sandwood Dr., Columbia, S.C. 29206

[21] Appl. No.: 530,831

[22] Filed: May 30, 1990

[51] Int. Cl.[5] ..... A47J 43/00

[52] U.S. Cl. ..... 220/669; 220/574; D7/584

[58] Field of Search ..... 220/85 R, 669, 574; D7/325, 558, 560, 565, 566, 570, 584, 585

[56] References Cited

U.S. PATENT DOCUMENTS

| | | | |
|---|---|---|---|
| D. 97,417 | 11/1935 | Slobodkin | D7/585 |
| D. 102,772 | 1/1937 | Williams | D7/565 |
| 282,654 | 9/1888 | Landsberger et al. | D7/584 |
| 2,533,853 | 12/1950 | Tinder | D7/584 X |
| 4,928,842 | 5/1990 | Swenson | 220/85 R |

*Primary Examiner*—Steven M. Pollard
*Attorney, Agent, or Firm*—Michael A. Mann

[57] ABSTRACT

A device for serving popcorn and the like comprising a bowl with a generally concave interior surface and a series of horizontal, circumferential ridges carried by the bowl, each with a face on the radially inward side of the ridge for resisting tangential movement of a first layer of popped corn in the bowl. The faces are approximately perpendicular to the interior surface of the bowl. When movement of the first layer is resisted, movement of all the popped corn in the bowl is resisted because popped corn kernels tends to interlock. The faces of the ridges need only be as high as one-third the height of a popped kernel of corn. Preferably, thereby are at least two ridges, a first ridge at the generally flattened central portion of a bowl and at least one additional ridge radially outward of the first ridge.

4 Claims, 2 Drawing Sheets

BOWL FOR SERVING POPCORN AND THE LIKE

BACKGROUND OF THE INVENTION

1. Field of the Invention

The present invention relates to bowls for serving popcorn. In particular, the present invention relates to bowls for resisting the movement and preventing the spillage of popcorn when one reaches into the bowl for a handful of popcorn.

2. Discussion of Background

Popcorn is frequently served in bowls having generally concave interiors. It is well known that one attempts to grasp a handful of popcorn from a curved bowl, the popcorn will tend to slide, sometimes sliding out of the other side of the bowl. By its nature, popcorn is light and airy and moves without much resistance when pressure is applied. Furthermore, the popped kernels tend to interlock and move together so that, when one attempts to reach into one side of a bowl, the popcorn will be pushed lockstep from the other side of the bowl.

Applicant knows of no bowl or container which solves the above mentioned problem other than the device in his copending application, Ser. No. 07/407,815, filed 09/15/89, to be issued 05/09/90 as U.S. Pat. No. 4,928,842, which is a pedestal attached to a bowl for stopping the movement of popcorn. That device, although effective in stopping popcorn, occupies a certain amount of the volume of the bowl interior, could become grasped in the attempt to grasp popped corn from the bowl, and makes cleaning of the improved bowl more difficult than cleaning a plain bowl.

For preventing the spillage of soup, U.S. Pat. No. 879,364, discloses a bowl having an inwardly flanged rim which retains soup sloshed about in the bowl. The larger the rim, the more effective such a bowl would be for preventing soup spillage. Since soup is eaten with a soup spoon, only a relatively small opening would be necessary for effective access to the interior of the bowl. Popcorn is usually eaten by hand. A bowl with a large flange on the rim would pose an obstacle to the hand and may trap escaping sufficient moisture from the freshly popped kernels to make them slightly soggy.

There is a need for a bowl for serving popcorn serving bowl which does not have the problems of existing bowls and does not limit access to the popped corn itself.

SUMMARY OF THE INVENTION

According to its major aspects, the present invention is a device for serving popcorn and the like comprising a bowl with a generally concave interior surface, a generally flattened central portion, a rim, and at least one ridge carried by the interior surface. The ridges have faces that are perpendicular to the interior surface and oriented on the radially inward side of the ridges. A first ridge is positioned about the generally flattened central portion. Additional ridges are spaced radially outward of the first ridge. Another ridge may be positioned near the rim.

The ridges are a feature of the present invention. The ridges are, in a preferred embodiment of the present invention, integral with the bowl and have a shallow profile, not larger than one inch and preferably not smaller than the height of one-third of a popped kernel of corn. In that height range, they can effectively resist the tangential movement of a first layer of popped corn along the interior surface of the bowl without interfering with the use of the bowl for eating popcorn or, for that matter, other purposes. Resisting the movement of the first layer prevents movement of the entire contents of the bowl.

The number, arrangement and height of the ridges is another feature of the present invention. The first ridge about the generally flattened central portion of the bowl is the most effective in resisting the movement of popcorn since the forces of the hand are directed toward the central portion of the bowl. Additional ridges between the first ridge and the rim improve performance, but, as the sides of the bowl curve upward, the face of each ridge may be made shorter than the preceding face since the combination of the face height, the vertical component of the bowl curvature and gravity will make it harder for the first layer of popped corn to overcome the obstacles presented by the additional ridges.

These and other features and advantages of the present invention will be apparent to someone skilled in the art from a careful reading of the following decription and a review of the drawings.

BRIEF DESCRIPTION OF THE DRAWINGS

The accompanying drawings, which are incorporated in and form a part of the specification, illustrate the invention and, together with the description, serve to explain the principles of the invention. In the drawings.

DETAILED DESCRIPTION OF THE PREFERRED EMBODIMENTS

The present invention is a device for serving popcorn and the like. Other light-weight items served in bowls and removed a portion at a time may also be served in the present invention.

Figure 1:
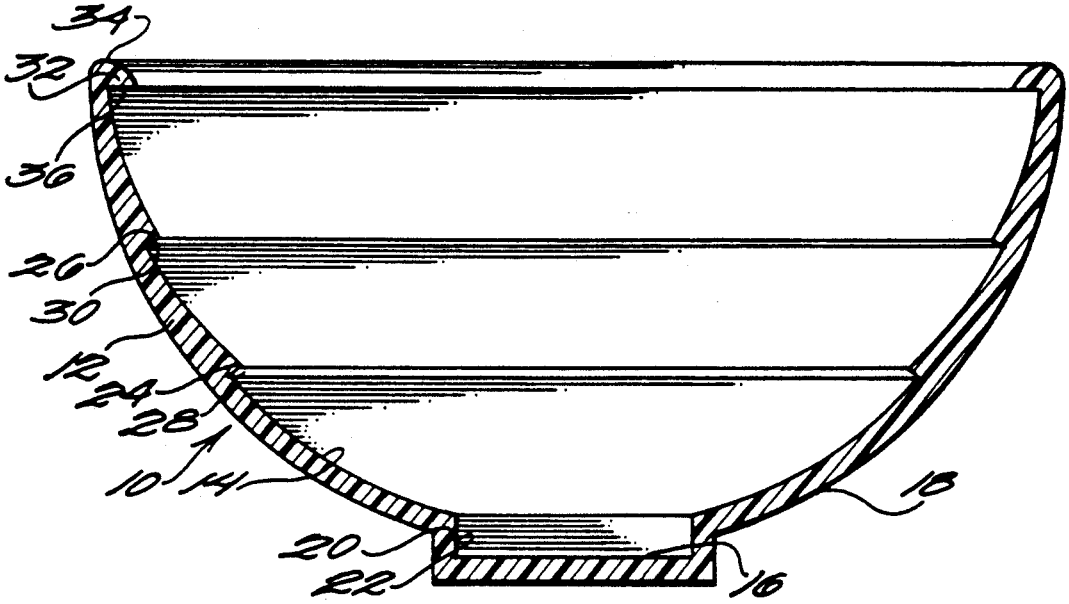
FIG. 1 is a cross sectional side view of a preferred embodiment of the present invention.
Figure 2:
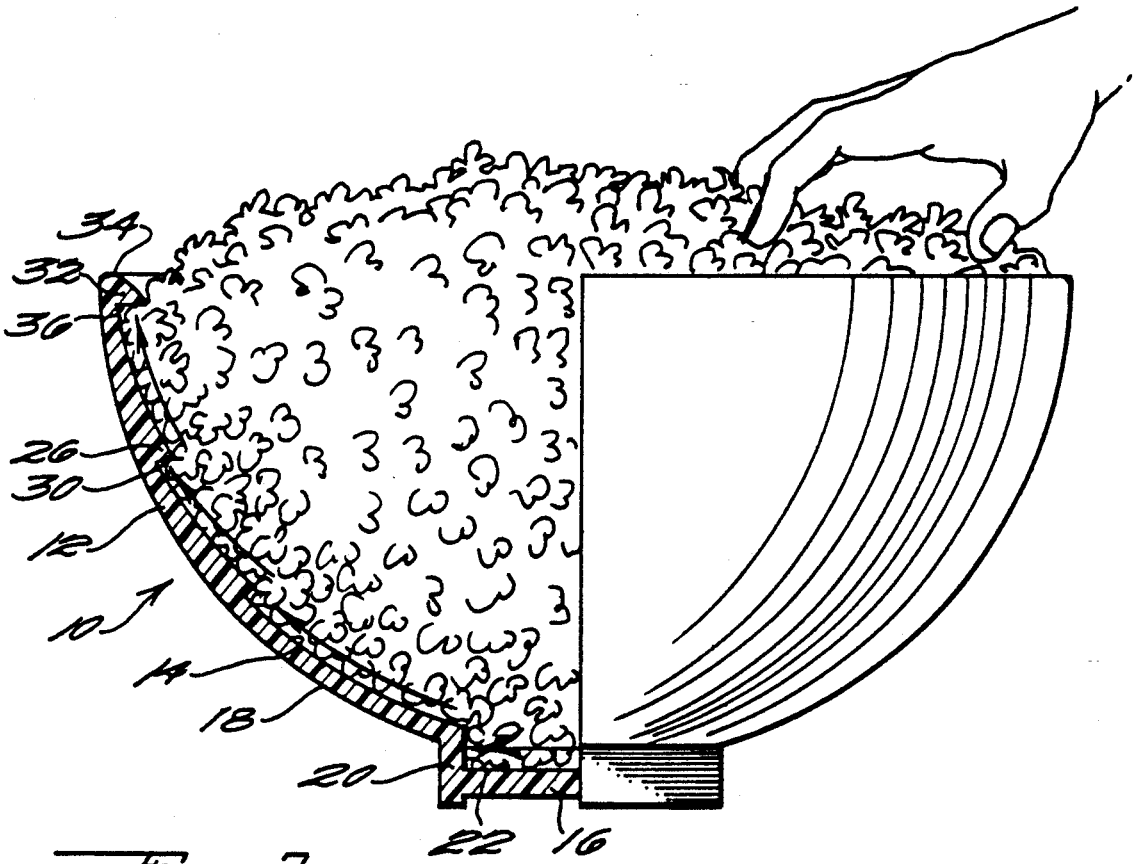
FIG. 2 is a quarter cross sectional side view of the preferred embodiment of FIG. 1 containing popcorn.

Referring now to FIGS. 1 and 2 showing bowl 10. Bowl 10 is symmetric about a central, vertical axis A and has a wall 12 with a generally concave interior surface 14 and central, flattened portion 16. The exterior surface 18 of bowl 10 may be any shape and decorated as desired, without affecting the present invention which is related to the interior structure and its cooperation with the popped corn. The popped corn is, of course, not a part of the present invention.

Central portion 116 is generally flat and circular. About central portion 16 is a first circumferential ridge 20. First ridge 20 has a face 22 generally perpendicular to flattened central portion 16 that is on the radially inward side of first ridge 20. Face 22 has a height, measured from flattened central portion 16 of not more than one inch and not less than one-third the height of a popped kernel of corn, preferably approximately one-half the height of a popped kernel of corn.

Radially outward of first ridge 20 are shown two additional, circumferential ridges, 24 and 26. Ridges 24, 26 have faces 28 and 30, respectively, which are approximately perpendicular to interior surface 14. A fourth ridge 32 is shown in FIGS. 1 and 2 near a rim 34. Fourth ridge 32 also has a face 36 approximately perpendicular to interior surface 14. It will be noted that, each face of each ridge is perpendicular to interior surface 14 in the vicinity of that ridge; thus, as interior surface curves upward, the orientation of a face will become less vertical. It is not necessary that faces 28, 30 and 36 be exactly perpendicular, only that they present an obstacle that cannot be easily surmounted by the popped corn kernels adjacent the ridge. An angle of ninety degress, a little more or a little less, between interior surface and a face is satisfactory.

Faces 28, 30, 36 of ridges 24, 26, and 32, respectively, are all of an effective height to resist the tangential movement of a first layer of popped corn, that is, the movement of popped kernels that are adjacent interior surface 14. These kernels move, if at all, tangent to interior surface 14; that is, they move parallel to interior surface 14 at each point along interior surface, as indicated by arrows in FIG. 2. Since the interior surfaces of bowls are generally made smooth to resist food particle build-up and facilitate cleaning, light-weight, dry items such as popped corn tend to slide easily against such surfaces. First ridge 20 and any additional ridges form low profile barriers that resist the movement of the first layer of popped corn.

Because of the extreme irregularity of the shape of popped corn, the popped kernels tend to interlock. Stopping the movement of one effectively stops those adjacent to it, and others adjacent to those. Thus, surprisingly, movement of the contents of bowl 10 is resisted when the ridges resist the movement of the first layer of popped corn only. Accordingly, a few low-profile ridges about the interior circumference of what is otherwise an ordinary bowl will have a significant effect on a large quantity of popped corn in the bowl. This effect will be evident in the greater ease of grasping a handful of popped kernels, since the kernels do not slide away from the hand, and especially in reducing spillage of popped corn when grasping a handful of kernels from a full bowl.

The number and size of ridges in a bowl depends on the size of the bowl, its shape, and to what extent it is usually filled. Bowls that are round will preferably have horizontal, circumferential ridges since popped corn contained therein could be approached by users from all sides. Very deep bowls need fewer ridges than very shallow bowls since gravity helps deeper bowls contain their contents. Bowls that are not normally filled to the top or are flared outwardly do not need a ridge near the rim.

The faces of ridges near the central, flatter portions of a bowl are more effective if they are higher rather than lower. Farther up the sides of a bowl, the faces of ridges need not be as high as ridges farther down the sides of a bowl, since gravity and the vertical component of the interior surface near the ridge combine with the ridges in resisting tangential movement of the first layer of popped corn. The faces need be no higher than one inch and preferably no shorter than one-third the height of a popped kernel of corn. Most preferably, a ridge is approximately one-half the height of a popped kernel of corn.

The ridges can be integral with or attached to the wall of a bowl. If integral, the ridges can be formed by casting, forging, stamping, pressing, crimping, molding or carving, depending on whether the bowl is made of metal, ceramic, glass, wood or plastic.

The side of a ridge opposite the face may be made to return immediately to the thickness of the wall before the ridge to save material or facilitate fabrication or may return to that thickness gradually as shown in FIGS. 1 and 2 to make cleaning easier.

Figure 3:
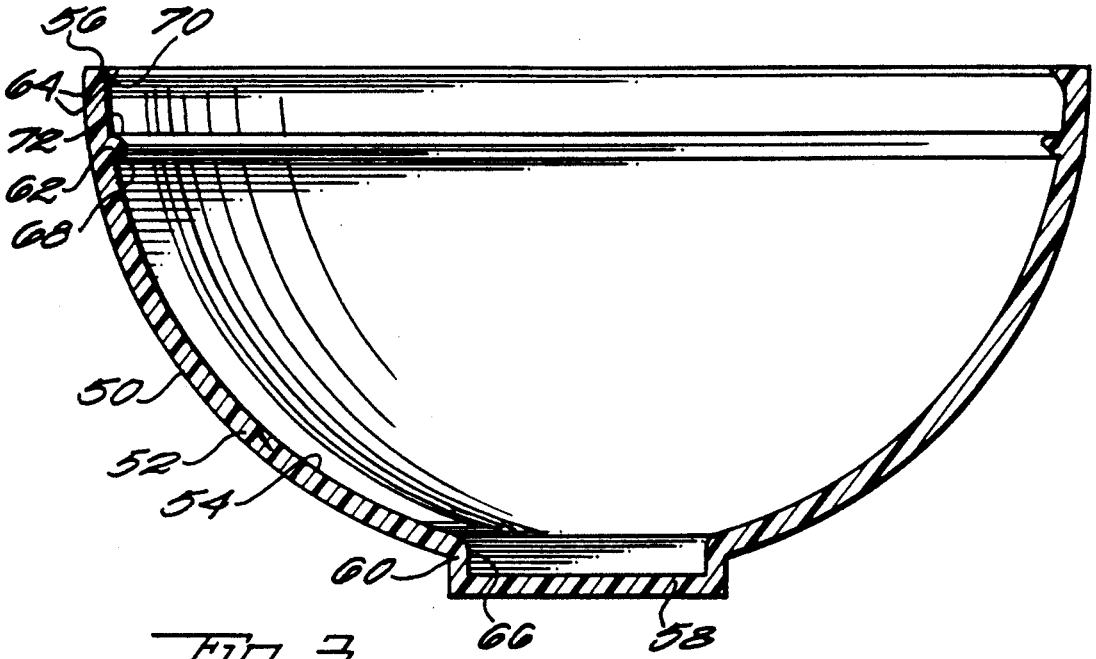
FIG. 3 is a cross sectional side view of an alternative preferred embodiment of the present invention.
Figure 4:
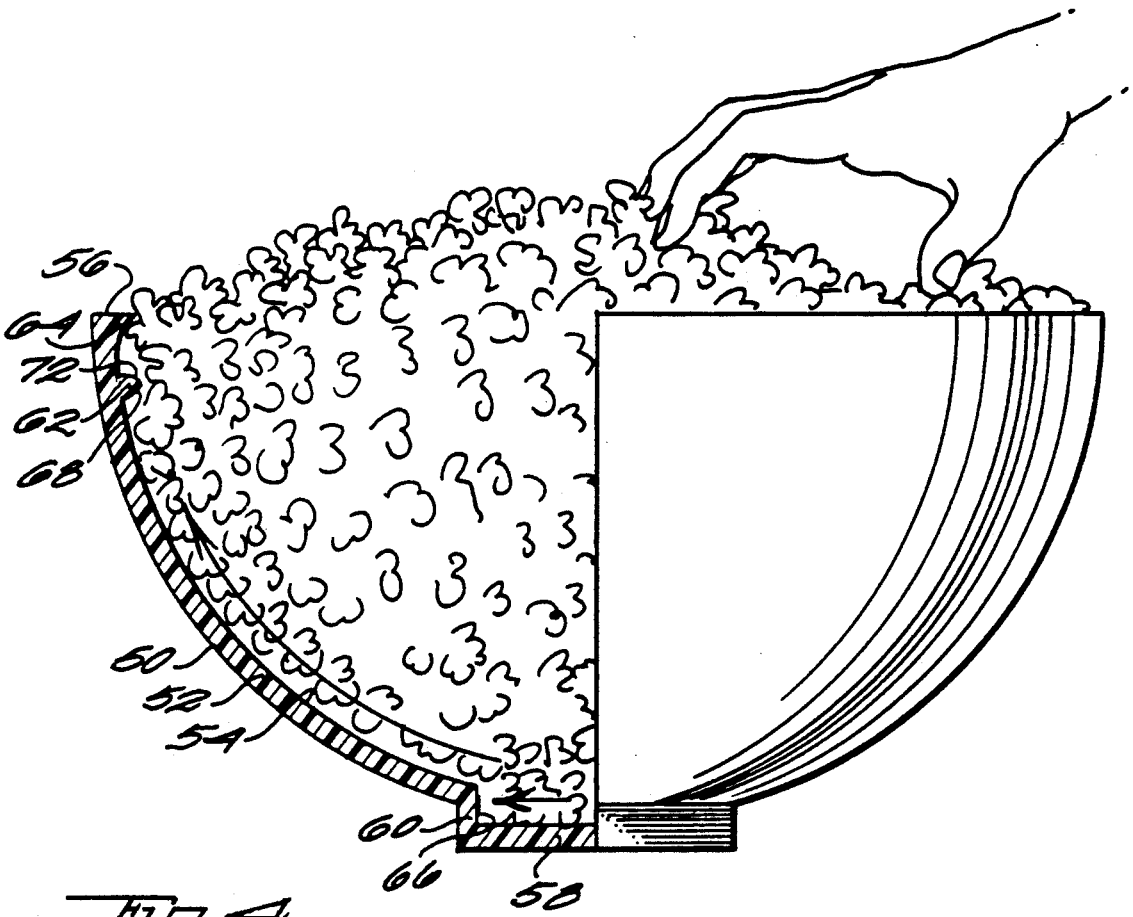
FIG. 4 is a quarter cross sectional side view of a second embodiment of the present invention containing popcorn.

FIGS. 3 and 4 show an alternate embodiment of the present device for serving popped corn. Bowl 50 has a wall 52 with an interior surface 54 and a rim 56. In the central portion of bowl 50 is a generally flattened portion 58. On interior surface 54 is a first ridge 60, a second ridge 62 and a third ridge 64. First ridge 60 has a face 66 perpendicular to flattened central portion 58 and is similar to first ridge 20 of FIGS. 1 and 2.

Second ridge 62 has a face 68 perpendicular to interior surface 54. Third ridge 64 is simply a slight inwardly flare of rim at 70. Second ridge 62 has a face 72 opposite face 68 which returns the thickness of wall 52 back to its original thickness immediately. This embodiment, shown in FIGS. 3 and 4, is sufficient to prevent the movement of popped corn in a bowl that may be used for other purposes as bowls are customarily used for such as serving food and mixing ingredients for baking. Second ridge 62 is spaced relatively far from first ridge 60, leaving a larger portion of interior surface 54 smooth.

It is to be understood that the foregoing description and specific examples are illustrative of the principles of the invention and that various other modifications and additions may be made thereto by those skilled in the art without departing from the spirit and scope of the invention as set forth in the following claims.

What is claimed is:

1. A device for serving popped corn and the like, comprising:

a bowl having a generally concave interior surface; and at least two generally circumferential ridges carried by said interior surface of said bowl, said at least two ridges having faces generally perpendicular to said interior surface for engaging said popped corn and resisting tangential movement of said popped corn along said interior surface, said faces being at least one-third the height of a popped kernel of corn.

2. The device as recited in claim 1 wherein wherein said faces are not more than approximately one inch in height.

3. The device as recited in claim 1, wherein said bowl has a flattened central portion and said at least two ridges further includes a ridge about the circumference of said central portion, said ridge having a face approximately perpendicular to said central portion.

4. The device as recited in claim 1, wherein said bowl has a generally flattened central portion and a rim and said at least two generally circumferential ridges further comprises:

a first ridge about said flattened central portion; and a second ridge spaced radially between said first ridge and said rim.

* * * * *